United States Patent [19]

Petersen

[11] 4,419,993

[45] Dec. 13, 1983

[54] ANTI-FOGGING SURGICAL MASK

[75] Inventor: Neil E. Petersen, St. Paul, Minn.

[73] Assignee: Minnesota Mining & Manufacturing Company, St. Paul, Minn.

[21] Appl. No.: 329,603

[22] Filed: Dec. 10, 1981

[51] Int. Cl.[3] ..... A62B 7/00

[52] U.S. Cl. ..... 128/201.15; 128/206.19; 128/139

[58] Field of Search ..... 128/201.15, 201.17, 128/206.19.139

[56] References Cited

U.S. PATENT DOCUMENTS

| | | | |
|---|---|---|---|
| 2,012,505 | 8/1935 | Goldsmith | 128/139 |
| 2,515,009 | 7/1950 | Hyghlago | 128/206.19 |
| 3,802,429 | 4/1974 | Bird | 128/206.19 |
| 3,888,246 | 6/1975 | Laner | 128/201.17 |
| 3,890,966 | 6/1975 | Aspelin et al. | 128/201.17 |
| 4,037,593 | 7/1977 | Tate, Jr. | 128/201.17 |

OTHER PUBLICATIONS

International Publication No. WO/813266, Disposable Surgical Face Mask and Method of Producing it.

*Primary Examiner*—Henry J. Recla

*Attorney, Agent, or Firm*—Donald M. Sell; James A. Smith; Robert W. Sprague

[57] ABSTRACT

Surgical masks comprising: (a) a main body portion comprising a filter portion which comprises filter means divided into an upper region and a lower region, the lower region of the filter means being more permeable to air than the upper region of the filter means; (b) means for providing an effective seal between the upper edge of the main body portion and the nose of the wearer; (c) and means for securing the mask over the mouth and nose of the wearer. A preferred surgical mask comprises a filter means comprising two distinct filter webs of different permeabilities. These surgical masks function as effective filters to the passage of bacteria-containing liquid droplets and may be suitably worn by eye-glass clad operating room staff members since exhaled air, which could otherwise fog eyeglasses, is directed downward away from the eyes of the wearer of the mask. Furthermore, these surgical masks are comfortable to wear and may assume a comfortable, off-the-face or "duckbill" configuration.

14 Claims, 4 Drawing Figures

ANTI-FOGGING SURGICAL MASK

The present invention relates to novel surgical masks.

Surgical masks are generally worn by operating room staff members during surgical operations in order to reduce the possibility of the patient becoming contaminated by bacteria contained in liquid droplets exhaled by staff members. Conventional surgical masks typically comprise a filter member which functions to prevent the passage of water droplets through the mask when the wearer exhales.

Unfortunately, fogging of eyeglasses worn by the staff members may accompany the wearing of many of the commercially available surgical masks. Fogging of eyeglasses occurs because exhaled air is typically warmer and more moist than room air. As the warm exhaled air rises past the eyeglasses, moisture may condense on them. Obviously, fogging of the eyeglasses of an operating room staff member, and of a surgeon in particular, is an undesirable occurence.

Anti-fog surgical masks are known in the art. For example, U.S. Pat. No. 3,888,246 (Lauer) discloses a surgical mask comprising a filtration medium and a sheet of air-impervious material (e.g., plastic film or non-woven fabric) which is said to prevent moist breath from rising over the upper portion of the mask and fogging the eyeglasses of the wearer of the mask. The air-impervious material may be on the exterior surface of the mask, within the mask, or on the interior surface of the mask.

U.S. Pat. No. 3,890,966 (Aspelin et al.) discloses a surgical mask similar to that disclosed in the above-mentioned U.S. Pat. No. 3,888,246 except that the air-impervious material here contains slits which define flaps that direct exhaled breath away from the eyes of the wearer of the mask.

Also, U.S. Pat. No. 4,037,593 discloses a surgical mask which includes a vapor barrier of soft closed cell foam material along the upper edge of the mask.

Unfortunately, while the above-mentioned surgical masks generally exhibit decreased tendency to cause fogging of eyeglasses, these masks may be a source of discomfort to the wearer. The discomfort experienced with many of these masks results from the interposition of a plastic film or foam barrier between the mask surface and the skin of the wearer and from a significant impermeable portion in the mask.

The present invention provides novel surgical masks for covering at least the nose, mouth and a portion of the chin of the wearer and comprising:

(a) a main body portion having an upper edge and a lower edge and comprising a filter portion between the upper edge and the lower edge, the filter portion comprising a filter means extending from a location at about the upper edge to a location at about the chin of the wearer, the filter means being divided into an upper region and a lower region, the upper region of the filter means being located at about the upper edge and providing between about 25 to 70 percent of the total area of the filter means, and the lower region of the filter means being adjacent to the upper region of the filter means and providing for substantially the remainder of the total area of the filter means;

the filter means being further characterized in that the upper region and the lower region of the filter means are permeable substantially throughout, the average permeability of the upper region of the filter means is at least about 6 cubic feet of air per square foot per minute, and the average permeability of the lower region of the filter means is at least about 22.25 cubic feet of air per square foot per minute and is greater than the average permeability of the upper region of the filter means by at least about 2.25 cubic feet of air per square foot per minute, the permeabilities being measured in accordance with ASTM D 737-75 (Reapproved 1980) using a pressure differential of 0.5 inch of water across the filter means;

(b) means at the upper edge for providing an effective seal between the upper edge of the main body portion and the nose of the wearer; and (c) means attached to the main body portion for securing the mask over the mouth and nose of the wearer; the mask being substantially flexible and also functioning to direct exhaled air away from the eyes of the wearer of the mask in order to reduce the possibility of fogging eyeglasses.

The surgical masks of the present invention function as effective barriers to the passage of bacteria and are anti-fogging due to the presence therein of a filter means which exhibits high filter efficiency and which has two regions of different air permeabilities. More particularly, in one embodiment of a surgical mask in accordance with the present invention, the filter means comprises a single filter web which has been fabricated in a manner to provide the two regions of differing air permeabilities. In another embodiment, the filter means comprises two distinct filter webs of differing air permeabilities. The more permeable region, in either embodiment, is located in the bottom portion of the mask where it functions to direct most of the exhaled air downward away from the eyes of the wearer, thereby reducing the possibility that eyeglasses will become fogged. Thus, the anti-fogging property exhibited by the surgical masks of the present invention is achieved without requiring the presence of plastic films, molded plastic members, foam members, paper members, cardboard members, or continuous resin coatings in these masks. Since the surgical masks of the present invention are anti-fogging, the masks can be worn by eyeglass-clad operating room staff members without the fear that their eyeglasses will fog to the point that vision is significantly impaired.

The surgical masks of the present invention are comfortable to wear since they do not require the presence of plastic films or foams which contact the skin of the wearer of the mask. Furthermore, the surgical masks of the present invention are particularly comfortable to wear since the filter means is permeable to air throughout substantially its entire area to permit easy breathing. Moreover, in a preferred embodiment, the surgical mask assumes a particularly comfortable off-the-face or "duckbill" configuration when worn. The masks of the present invention are also substantially flexible (i.e., do not exhibit the rigidity of heat-molded, cup-shaped masks).

The present invention is described in more detail hereinafter with reference to the accompanying drawings wherein like reference characters refer to the same element in the several views and in which.

Figure 1:
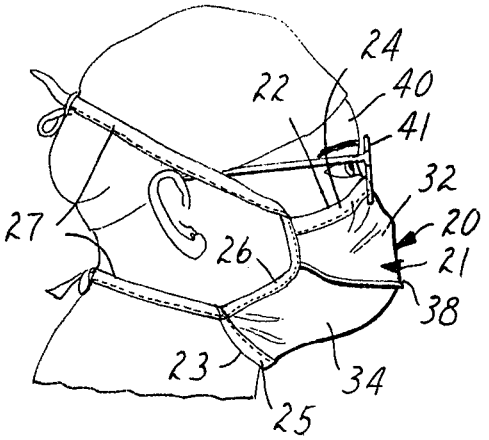
FIG. 1 is a side elevational view of a preferred embodiment of a surgical mask in accordance with the present invention.

As employed throughout this application, "filter means" designates that portion of the filter web or webs covering the region of the face between about the bridge of the nose (i.e., about the point where the upper edge of the mask is located) and a location at about the chin. Substantially all air passes through this portion of the filter web or webs. It is believed that no significant portion of the air passes through the region of the mask beneath the chin. Thus, "filter means" is designated as stated above even though the filter web may extend beneath the chin as shown in the drawings. Also, "filter means" as employed herein designates a filter web or filter webs. In the present invention the varied permeability is obtained via such above webs without requiring the inclusion of additional woven or non-woven webs (e.g., cover webs), slit or unslit plastic films, molded plastic members, foam members, paper members, cardboard members or continuous resin coatings adjacent to or coated onto the filter web or filter webs.

One embodiment of a surgical mask in accordance with the present invention comprises a main body portion having an upper edge and comprising a filter portion (which prevents the passage of bacteria-containing liquid droplets carried in exhaled air). The filter portion comprises a filter means which has been divided into an upper region and a lower region and which comprises a single filter web. The region of the filter web in the upper region of the filter means is less permeable to air than the region of the filter web in the lower region of the filter means. This embodiment of a surgical mask also includes means for providing an effective seal between the upper edge of the main body portion, and the nose of the wearer, means for securing said mask over the mouth and nose of the wearer, and a cover web or cover webs adjacent the main body portion. These elements will be discussed in greater detail below in the context of the illustrated embodiment.

Figure 2:
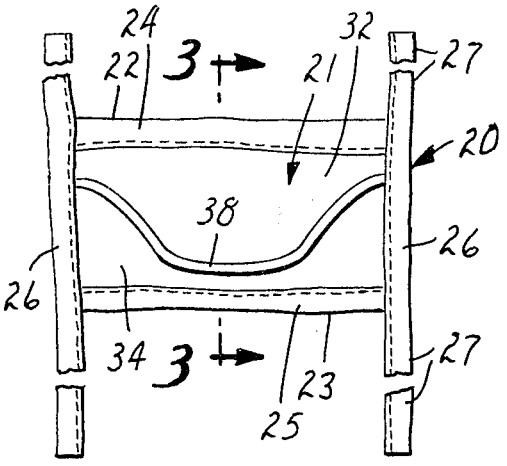
FIG. 2 is a plane view of the embodiment of FIG. 1 showing the surgical mask in a folded state.

Referring now to FIGS. 1 and 2, there is shown a preferred embodiment of a surgical mask 20 in accordance with the present invention. Surgical mask 20 includes a main body portion 21 having an upper edge 22 and a lower edge 23. Surgical mask 20 includes binding 24 along the upper edge 22 of main body portion 21, binding 25 along the lower edge 23 of main body porton 21, and bindings 26 along the side edges of main body portion 21. As illustrated in FIGS. 1 and 2, bindings 26 are extended at the corners of surgical mask 20 to provide tie strings 27 which permit the tying of surgical mask 20 at the back of the head and neck of the wearer as shown in FIG. 1. As illustrated in FIG. 1, main body portion 21 is shaped so as to provide a mask having an off-the-face or "duckbill" configuration.

Figure 3:
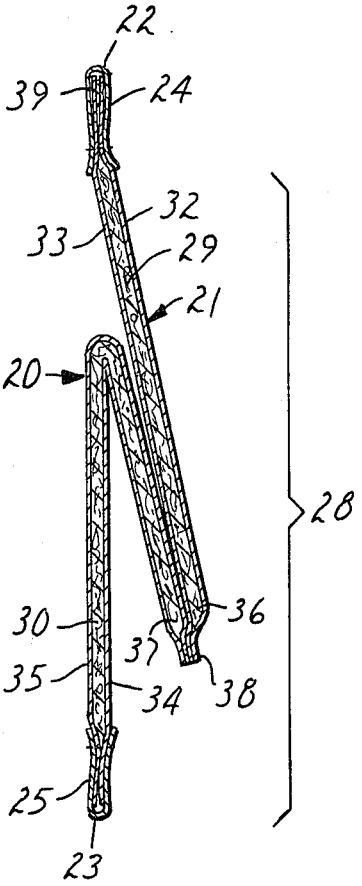
FIG. 3 is an enlarged sectional view taken along the line 3—3 of FIG. 2.
Figure 4:
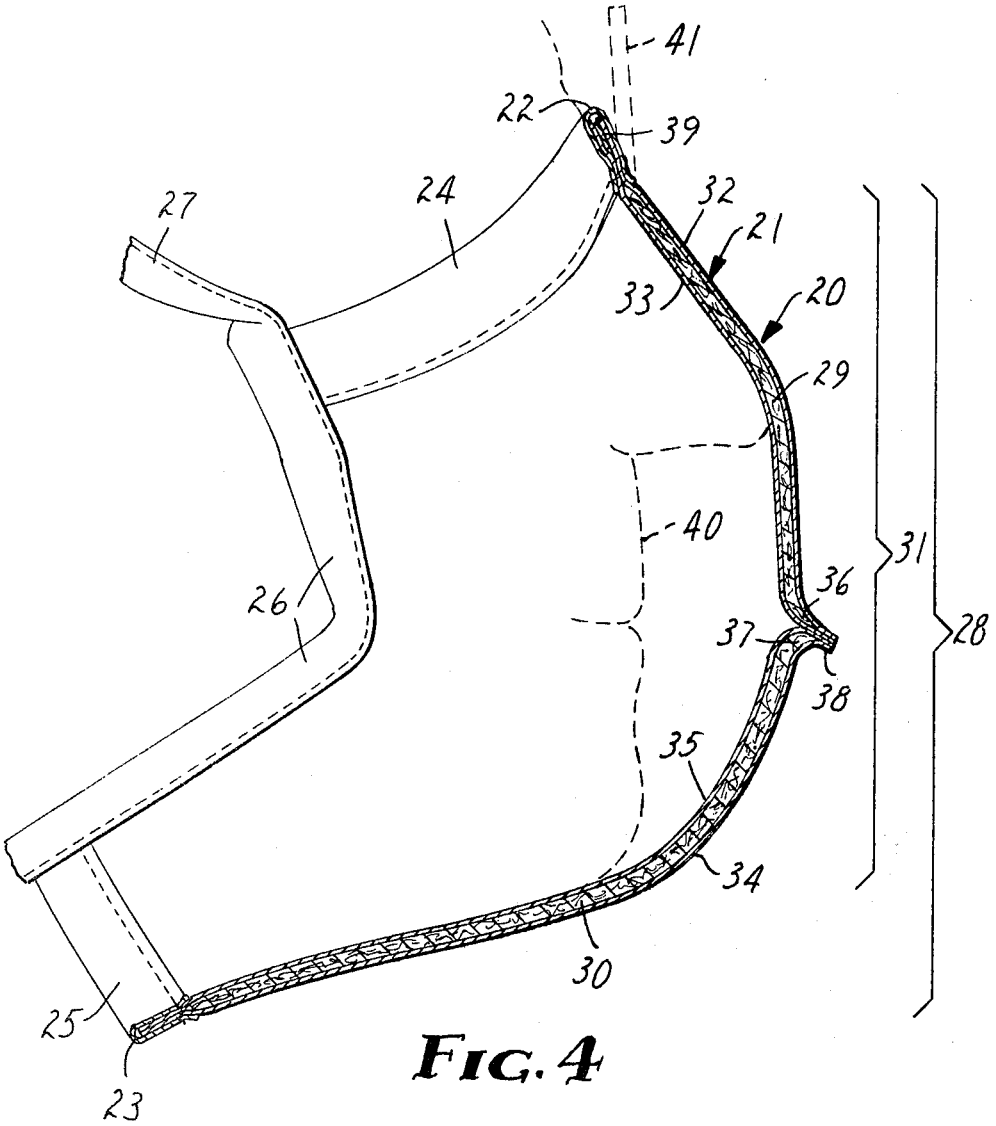
FIG. 4 is an enlarged sectional view of the embodiment of FIG. 1.

The construction of surgical mask 20 is more easily understood by reference to FIGS. 3 and 4. Referring to those figures, it is seen that main body portion 21 comprises filter portion 28 situated between upper edge 22 and lower edge 23. Filter portion 28 comprises upper filter web 29 and lower filter web 30. That portion of filter portion 28 extending from a location at about upper edge 22 to a location at about the chin of the wearer is the filter means 31 (illustrated in FIG. 4). Thus, filter means 31 comprises the entirety of upper filter web 29 and the upper portion of lower filter web 30. The upper region of filter means 31 consists of upper filter web 29 and the lower region of filter means 31 consists of that portion of lower filter web 30 which extends from upper filter web 29 to a location within lower filter web 30 adjacent about the chin of the wearer. As illustrated in FIG. 3, it is also seen that main body portion 21 comprises cover webs 32, 33, 34 and 35 situated adjacent filter portion 28 (and filter means 31), cover webs 32 and 33 being adjacent to and on opposite sides of upper filter web 29 of filter portion 28 and cover webs 34 and 35 being adjacent to and on opposite sides of lower filter web 30 of filter portion 28. Lower end 36 of upper filter web 29 and upper end 37 of lower filter web 30 are connected by means of seal 38 which joins cover webs 32, 33, 34 and 35. Seal 38 may be achieved by any conventional means such as heat sealing (e.g., thermal or ultrasonic means) or adhesive bonding. Binding 24 is shown enveloping noseclip means 39 such as a strip of dead soft aluminum in order to provide an effective seal between upper edge 22 of main body portion 21 and the nose of the wearer. The seal should prevent escape of significant amounts of exhaled air from between the upper edge 22 of main body portion 21 and the face of the wearer since such escape could lead to fogging of eyeglasses 41.

The shapes of upper filter web 29 and cover webs 32 and 33 are most clearly seen in FIGS. 2 and 3. While it is not readily apparent from FIG. 2, lower filter web 30 and cover webs 34 and 35 are of similar shapes as upper filter web 29 and cover webs 32 and 33 and have been folded back upon themselves. The off-the-face or "duckbill" configuration of surgical mask 20 results from employing upper filter web 29, lower filter web 30 and cover webs 32, 33, 34 and 35 which are shaped as illustrated in FIGS. 2 and 3.

FIG. 4 illustrates most clearly the off-the-face or "duckbill" configuration of surgical mask 20. It is seen that surgical mask 20 forms a void between surgical mask 20 and the region of the face 40 of the wearer starting at the tip of the nose and extending to the area at about the chin. Since surgical mask 20 stands away from the face (i.e., does not conform to the contours of the face) in the above-described regions, surgical mask 20 is comfortable to wear and permits easy breathing.

In order to provide surgical masks exhibiting the desired performance, it is important that the filter means meet the following criteria. The average permeability of the upper region of the filter means is at least about 6 cubic feet of air per square foot per minute, the average permeability of the lower region of said filter means is at least about 22.25 cubic feet of air per square foot per minute, and the average permeability of the lower region of the filter means is greater than the average permeability of the upper region by at least about 2.25 cubic feet of air per square foot per minute. Also, the upper and lower regions of the filter means are permeable throughout substantially their entire areas. The above-described permeabilities are determined in accordance with Standard Methods Test entitled "Air Permeability of Textile Fabrics" (ASTM D 737-75 (Reapproved 1980)) using a pressure differential of 0.5 inches of water across the filter means and represent the permeabilities of the upper and lower regions of the filter means after the mask has been assembled. Depending on how the masks of the present invention are assembled, some compaction of the filter web or webs may occur during the manufacturing process. The result of such compaction is normally a decrease in the permeabilities originally exhibited by the filter web or webs prior to the incorporation thereof in a mask.

It is to be understood that "average" permeability as used herein indicates that the permeabilities of the upper region and the lower region of the filter means are to be determined for each region taken in its entirety. The permeability within the upper region or the lower region of the filter means need not be uniform throughout the region so long as the average permeability satisfies the above-described permeability criteria.

While the permeability within the upper region and the lower region of the filter means may be non-uniform, it is important that the nature of the upper region and the lower region of the filter means be such as to provide a mask which functions to direct exhaled air away from the eyes of the wearer of the mask (in order to reduce the possibility of fogging eyeglasses). For example, the upper region of the filter means should not be provided with a band near the upper edge of the main body portion which is so permeable to air that fogging of eyeglasses can easily occur.

The amount (area) of the regions of differing air permabilities in the filter means also influences the anti-fogging performance of the mask. The upper region of the filter means provides for between about 25 and 70 percent of the total area of the filter means, the lower region of the filter means providing for substantially the remainder of the total area of the filter means.

A surgical mask comprising filter means meeting the above-described permeability and area criteria is anti-fogging since it directs a substantial amount of exhaled air downward away from the eyes of the wearer of the mask.

The preferred surgical masks of the present invention comprise a filter means meeting the following permeability criteria. The average permeability of the upper region of the filter means is greater than 20 cubic feet of air per square foot per minute and the average permeability of the lower region of the filter means is greater than the average permeability of the upper region of the filter means by at least about 8 cubic feet of air per square foot per minute and preferably by at least 12 cubic feet of air per square foot per minute. Preferred surgical masks of the present invention also comprise a filter means wherein the upper region of the filter means provides between about 45 and 55 percent of the total area of the filter means, the lower region of the filter means providing substantially the remainder of the total area of the filter means. Additionally, preferred surgical masks of the present invention comprise a filter means wherein the permeabilities are substantially uniform within each of the upper region and lower region of the filter means.

In achieving the optimum off-the-face or "duckbill" configuration in the preferred surgical mask of the present invention which comprises an upper filter web and a lower filter web, desirable results are obtained when the upper filter web (or upper region of the filter means) provides approximately 50 percent of the total area of the filter means, the lower filter web (or lower region of the filter means) providing substantially the remainder of the total area of the filter means. An upper filter web and lower filter web of these dimensions also provides for suitable anti-fogging performance of the mask.

Suitable webs for employment as the filter means in the masks of the present invention are well-known in the art and include such materials as melt-blown polypropylene, melt-blown polyester, and fiberglass. One method for forming suitable fibrous webs of polypropylene, polyester and the like is described in U.S. Pat. No. 3,613,678 (Mayhew), incorporated herein by reference. More particularly, the method described in said U.S. Pat. No. 3,613,678 involves the extrusion a fine stream of a molten polymeric material into a stream of heated air to obtain fibers of the desired dimension.

The fibrous webs employed as the filter means in the masks of the present invention may be electrically charged in order to obtain desired properties. Examples of suitable electrically charged webs are those described in U.S. Pat. Nos. 3,998,916 (Van Turnhout) and 4,215,682 (Kubik et al.), both incorporated herein by reference. The electrically charged fibrous webs described in said U.S. Pat. No. 3,998,916 are formed from a film of a high molecular weight non-polar substance. The film is stretched and at least one side of the stretched web is then homopolarly charged by a plurality of corona charging elements. The resulting charged film is then fibrillated, collected and processed into a filter. The electrically charged fibrous webs described in said U.S. Pat. No. 4,215,682 are formed by introduction of a persistent electric charge into melt-blown fibers during the melt-blowing process.

In the embodiment in which the filter means comprises a single filter web, the two regions of differing air permeabilities (i.e., the upper region and the lower region of the filter means) may be provided by a variety of methods including, for example, physical compaction of the upper region of the filter web with or without the application of heat. Another method is the formation of a filter web which is greater in thickness in the upper region of the web than the lower region of the web.

A preferred surgical mask in accordance with the present invention comprises, as the filter means, an upper filter web and a lower filter web which are described as follows. It is preferred that the permeabilities stated below for the preferred upper and lower filter webs not be significantly reduced during the assembly of the mask.

In the preferred mask, the upper filter web provides approximately 50 percent of the total area of the filter means, with the lower filter web providing substantially the remainder of the filter means. The lower filter web extends to a position beneath the chin of the wearer.

The filter web for the upper filter web comprises a melt-blown polypropylene web prepared from polypropylene fibers ranging from about 0.4 to 6.5 microns in diameter, the average diameter being about 1.6 microns. The web is prepared in accordance with the procedures described in said U.S. Pat. No. 3,613,678 and has a permeability of about 47.5 cubic feet of air per square foot of web per minute prior to its incorporation into a mask.

The filter web for the lower filter web also comprises a melt-blown polypropylene web, but here the web is prepared from polypropylene fibers ranging from about 0.25 to 9.0 microns in diameter, the average diameter being about 2.2 microns. The web is electrically charged and prepared in accordance with the procedures described in said U.S. Pat. No. 4,215,682 and has a permeability of about 71 cubic feet of air per square foot of web per minute prior to its incorporation into a mask.

The cover webs employed in the surgical mask should exhibit adequate strength and flexibility and should preferably be substantially fuzz-free. It is important that the particular cover webs selected do not significantly alter the desired anti-fogging characteristic of these masks which is achieved through employment of a filter means comprising an upper region and a lower region which exhibit different permeabilities.

Examples of suitable materials for use as the cover webs are well-known in the art and include such materials as dry-laid and wet-laid non-wovens comprising rayon, polyester and other suitable fibers; woven fabrics; and knitted fabrics. A preferred material for use as the cover webs is a non-woven, viscose rayon web prepared by means of a dry-laid process. The rayon fibers are 1.5 denier by 1 9/16 inches in length and are bonded with "Rhoplex B-15" (an acrylic copolymer emulsion commercially available from Rohm and Haas) applied using a padding roll. Another preferred material for use as the cover webs is "Evolution Fabric" (a spun-bonded polypropylene web commercially available from Kimberly-Clark Corp.) The preferred mask of the present invention (i.e., that illustrated in FIGS. 1–4) comprises the above-described non-woven, viscose rayon web as cover webs 32, 33 and 35 and the above-described "Evolution Fabric" as cover web 34. Employment of a polypropylene web as cover web 34 facilitates rapid formation of seal 38 by ultrasonic heat sealing means.

Materials suitable for use as bindings 24, 25 and 26 are well-known in the art and include non-woven materials formed by both wet-laid or dry-laid processes and consisting of rayon, polyester or like fibers; calendared spun-bonded webs of polypropylene, polyethylene or polyester; and reinforced paper. The preferred material for bindings 24, 25 and 26 is a spun-bonded polypropylene web which has been embossed using heat and pressure.

The surgical masks of the present invention may be manufactured conveniently using conventional methods.

It is understood that other variations and modifications can be made without departing from the spirit and scope of the invention.

What is claimed is:

1. An anti-fog surgical mask for covering at least the nose, mouth and a portion of the chin of the wearer, comprising:

(a) a main body portion having an upper edge and a lower edge and comprising a filter portion between said upper edge and said lower edge, said filter portion comprising a filter means extending from about said upper edge to a location at about the chin of the wearer, said filter means divided into an upper region and a lower region, said upper region of said filter means being located at about said upper edge and providing between about 25 and 70 percent of the total area of said filter means, and said lower region of said filter means being adjacent to said upper region of said filter means and providing substantially the remainder of the total area of said filter means;

said filter means being further characterized in that said upper region and said lower region of said filter means are permeable substantially throughout, the average permeability of said upper region of said filter means is at least about 6 cubic feet of air per square foot per minute, and the average permeability of said lower region of said filter means is at least about 22.25 cubic feet of air per square foot per minute and is greater than the average permeability of said upper region of said filter means by at least about 2.25 cubic feet of air per square foot per minute, the permeabilities being measured in accordance with ASTM D 737-75 (Reapproved 1980) using a pressure differential of 0.5 inch of water across said filter means;

(b) means at said upper edge for providing an effective seal between said upper edge of said main body portion and the nose of the wearer; and (c) means attached to said main body portion for securing said mask over the mouth and the nose of the wearer; said mask being substantially flexible and said upper region being oriented with respect to said lower region such that exhaled air is directed away from the eyes of the wearer of said mask in order to reduce the possibility of fogging eyeglasses.

2. An antifog surgical mask in accordance with claim 1, wherein said filter means comprises a single filter web.

3. An anti-fog surgical mask in accordance with claim 2, wherein said upper region of said filter means accounts for between about 45 and 55 percent of the total area of said filter means.

4. An anti-fog surgical mask in accordance with claim 2, wherein the average permeability of said upper region of said filter means is at least about 20 cubic feet of air per square foot per minute and the average permeability of said lower region of said filter means is greater than the average permeability of said upper region of said filter means by at least about 8 cubic feet of air per square foot per minute.

5. An anti-fog surgical mask in accordance with claim 4, wherein the average permeability of said lower region of said filter means is greater than the average permeability of said upper region by at least about 12 cubic feet of air per square foot per minute.

6. An anti-fog surgical mask comprising:

(a) a main body portion having an upper edge and a lower edge and comprising a filter portion between said upper edge and said lower edge, said filter portion comprising a filter means extending from a location at about said upper edge to a location at about the chin of the wearer, said filter means divided into an upper region comprising an upper filter web and a lower region comprising a lower filter web, said upper filter web being located at about said upper edge, having a lower end, and providing between about 25 and 70 percent of the total area of said filter means, and said lower filter web having an upper end and providing substantially the remainder of the total area of said filter means, said upper filter web and said lower filter web being connected at said lower end of said upper filter web and said upper end of said lower filter web;

said filter means being further characterized in that said upper region and said lower region of said filter means are permeable substantially throughout, the permeabilities of said upper region and said lower region of said filter means are substantially uniform throughout each of said upper region and said lower region, the average permeability of said upper region of said filter means is at least about 6 cubic feet of air per square foot per minute, and the average permeability of said lower region of said filter means is at least about 22.25 cubic feet of air per square foot per minute and is greater than the average permeability of said upper region of said filter means by at least about 2.25 cubic feet of air per square foot per minute, the permeabilities being measured in accordance with ASTM D 737-75 (Reapproved 1980) using a pressure differential of 0.5 inch of water across said filter means;

(b) means at said upper edge for providing an effective seal between said upper edge of said main body portion and the nose of the wearer; and (c) means attached to said main body portion for securing said mask over the mouth and the nose of the wearer; said mask being substantially flexible and said upper region being oriented with respect to said lower region such that exhaled air is directed away from the eyes of the wearer of said mask in order to reduce the possibility of fogging eyeglasses.

7. An anti-fog surgical mask in accordance with claim 6, wherein said upper region of said filter means provides between about 45 and 55 percent of the total area of said filter means.

8. An anti-fog surgical mask in accordance with claim 7, wherein the average permeability of said upper region of said filter means is at least about 20 cubic feet of air per square foot per minute and the average permeability of said lower region of said filter means is greater than the average permeability of said upper region of said filter means by at least 8 cubic feet of air per square foot per minute.

9. An anti-fog surgical mask in accordance with claim 6, wherein the average permeability of said upper region of said filter means is at least about 20 cubic feet of air per square foot per minute and the average permeability of said lower region of said filter means is greater than the average permeability of said upper region of said filter means by at least about 8 cubic feet of air per square foot per minute.

10. An anti-fog surgical mask in accordance with claim 9, wherein the average permeability of said lower region of said filter means is greater than the average permeability of said upper region of said filter means by at least 12 cubic feet of air per square foot per minute.

11. An anti-fog surgical mask in accordance with claim 6, wherein said upper filter web and said lower filter web comprise polypropylene and said lower filter web is electrically charged.

12. An anti-fog surgical mask in accordance with claim 6, further comprising cover webs situated on both sides of said filter means.

13. An anti-fog surgical mask in accordance with claim 6, wherein said surgical mask is an off-the-face surgical mask.

14. An anti-fog surgical mask in accordance with claim 6, wherein said filter portion extends beneath the chin of the wearer.

* * * * *